US007419350B2

(12) United States Patent
Lombardo et al.

(10) Patent No.: US 7,419,350 B2
(45) Date of Patent: Sep. 2, 2008

(54) CONFIGURING OPERATIVE ARM OF EXCAVATOR WITH ADAPTER BODY TO EXTEND OPERATIVE ARM

(75) Inventors: Orlando Lombardo, Venaria (IT); Davide Caporale, Turin (IT); Luca Fontana, Turin (IT)

(73) Assignee: CNH America LLC, New Holland, PA (US)

( * ) Notice: Subject to any disclaimer, the term of this patent is extended or adjusted under 35 U.S.C. 154(b) by 477 days.

(21) Appl. No.: 11/050,056

(22) Filed: Feb. 3, 2005

(65) Prior Publication Data

US 2005/0188518 A1 Sep. 1, 2005

(51) Int. Cl.
*E02F 3/36* (2006.01)

(52) U.S. Cl. ..... 414/685; 37/468; 414/723

(58) Field of Classification Search ..... 414/685, 414/680, 699, 723, 722; 37/468
See application file for complete search history.

(56) References Cited

U.S. PATENT DOCUMENTS 3,465,904 A * 9/1969 Pensa ..... 414/694
4,218,837 A * 8/1980 Peterman ..... 37/443
5,484,250 A * 1/1996 Gilmore et al. ..... 414/723
5,802,753 A * 9/1998 Raunisto ..... 37/468
2004/0076502 A1 * 4/2004 Nissing et al. ..... 414/699

* cited by examiner

*Primary Examiner*—Donald Underwood
(74) *Attorney, Agent, or Firm*—Patrick M. Sheldrake; John William Stader; Michael G. Harms

(57) ABSTRACT

An excavator includes an undercarriage including a track, a turret rotatable on the undercarriage, the turret including a chassis, a first operative arm set, a second operative arm set, an adapter body coupling the first operative arm set to the second operative arm set; and a work tool coupled to the distal end of the second distal arm. The first operative arm set comprises (i) a main arm rotatably mounted on the chassis, (ii) a first distal arm rotatably mounted on the main arm, (iii) a main hydraulic actuator coupled to the main arm and the chassis and (iv) a first distal hydraulic actuator, with the main hydraulic actuator being operable to rotate the main arm relative to the chassis and the first distal hydraulic actuator being coupled to the distal arm. The second operative arm set comprises (i) an intermediate arm rotatably mounted on the first distal arm, (ii) a second distal arm rotatably coupled to the intermediate arm, (iii) an intermediate actuator coupled to the intermediate arm and the second distal arm and (iv) a second distal hydraulic actuator coupled the second distal arm. The first distal arm includes a distal end coupled to the adapter body, the intermediate arm includes a proximal end coupled to the adapter body and a distal end coupled to the second distal arm, and the second distal arm includes a proximal end coupled to the intermediate arm and a distal end coupled to the work tool. The distal end of the first distal arm is adapted to be coupled to the work tool whereby the work tool and adapter body are interchangeable.

9 Claims, 7 Drawing Sheets

CONFIGURING OPERATIVE ARM OF EXCAVATOR WITH ADAPTER BODY TO EXTEND OPERATIVE ARM

BACKGROUND OF THE INVENTION

The preferred embodiment described herein relates to a method for configuring the operative arm of an excavator.

In the fields of excavation, demolition and construction, excavators differ in their loading class, the length of their operative arm and the type of accessory or work tool (e.g. a bucket, a grabbing and lifting claw, a shear, a hydraulically actuated hammer) they mount at the end of the arm. In comparison with arms necessary for normal excavation operations, machines provided with extremely long arms are known, in such a way as to have a wide range of action, needed for example in the demolition of buildings with relatively high floors, or when cleaning canals and river beds.

The production volumes required for machines fitted with arms with a wide range of action are relatively low and thus entail high development and manufacturing costs. Moreover, such machines are manufactured in a dedicated manner, so the availability of the machines and/or of their components in stock is low or even nil, and the costs and times of delivery of the spare parts are high.

An object of the preferred embodiment is to provide a method for configuring an operative arm of an excavator that requires a limited number of dedicated components. Those dedicated components that are required should be simply constructed.

SUMMARY OF THE INVENTION

According to an aspect of the present invention, a method of configuring an operative arm of a normally produced earth moving machine, where the operative arm includes a main arm connected to a chassis of the earth moving machine and a distal arm connected to the main arm, includes the steps of coupling an adapter body to an end of the operative arm and coupling an extending arm to the distal arm via the adapter body.

According to another aspect of the invention, an excavator includes a first operative arm, a second operative arm, an adapter body, and a work tool. Each of the first operative arm and the second operative arm is configured to be coupled to the adapter body and the work tool.

According to yet another aspect of the invention, an excavator comprises an undercarriage including a track, a turret rotatable on the undercarriage, the turret including a chassis, a first operative arm set, a second operative arm set, an adapter body coupling the first operative arm set to the second operative arm set; and a work tool coupled to the distal end of the second distal arm. The first operative arm set comprises (i) a main arm rotatably mounted on the chassis, (ii) a first distal arm rotatably mounted on the main arm, (iii) a main hydraulic actuator coupled to the main arm and the chassis and (iv) a first distal hydraulic actuator, with the main hydraulic actuator being operable to rotate the main arm relative to the chassis and the first distal hydraulic actuator being coupled to the distal arm. The second operative arm set comprises (i) an intermediate arm rotatably mounted on the first distal arm, (ii) a second distal arm rotatably coupled to the intermediate arm, (iii) an intermediate actuator coupled to the intermediate arm and the second distal arm and (iv) a second distal hydraulic actuator coupled the second distal arm. The first distal arm includes a distal end coupled to the adapter body, the intermediate arm includes a proximal end coupled to the adapter body and a distal end coupled to the second distal arm, and the second distal arm includes a proximal end coupled to the intermediate arm and a distal end coupled to the work tool. The distal end of the first distal arm is adapted to be coupled to the work tool whereby the work tool and adapter body are interchangeable.

BRIEF DESCRIPTION OF THE DRAWINGS

The invention shall now be described with reference to the accompanying drawings, which illustrate a non-limiting embodiment thereof, in which.

DETAILED DESCRIPTION OF THE PREFERRED EMBODIMENT

Figure 1:
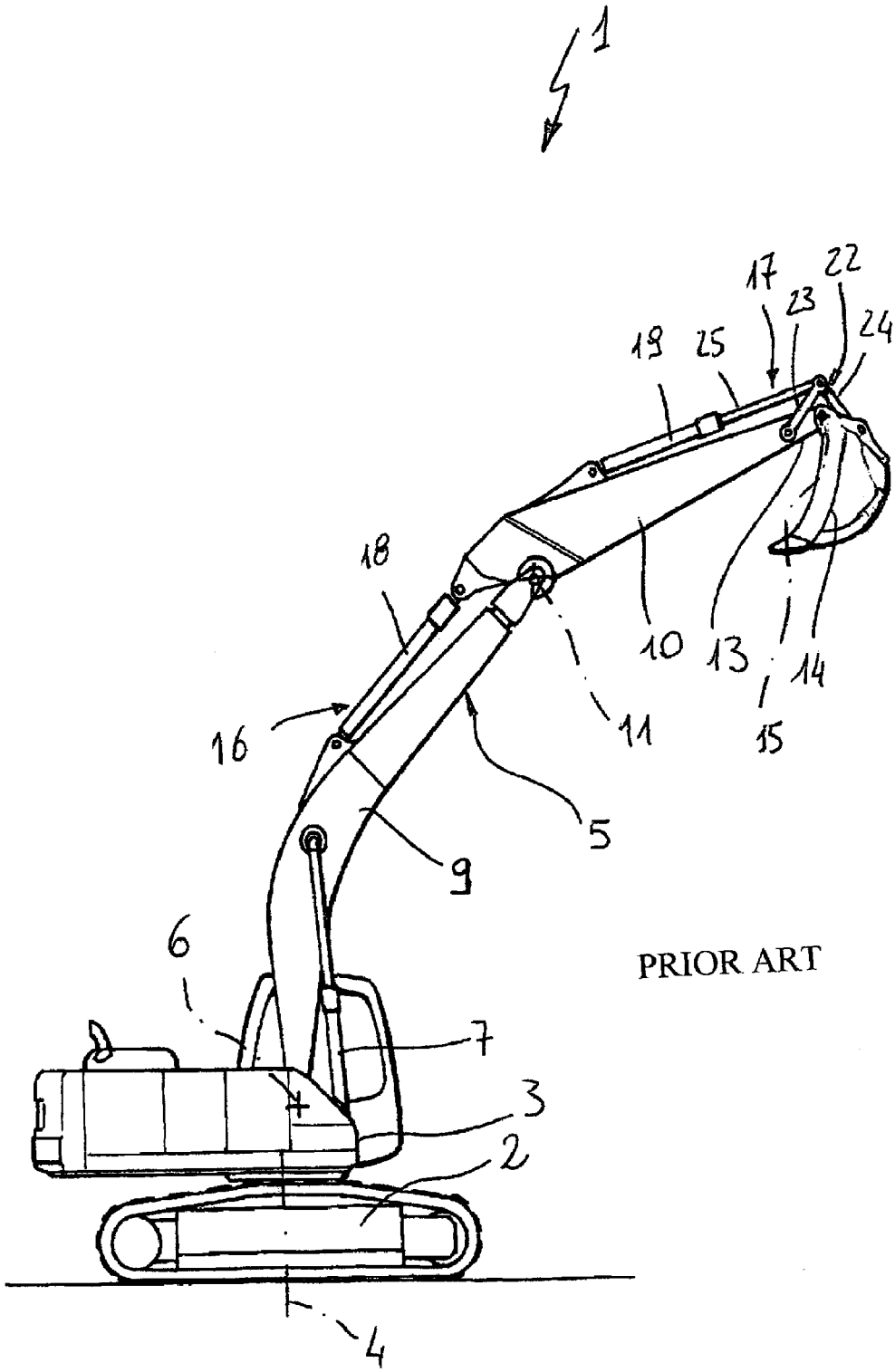
PRIOR ART Fig. 1
FIGS. 1 and 2 show lateral elevation views of two different normally produced excavators for implementing the method of the present invention.

In FIG. 1, the reference 1 designates a normally produced excavator, such as an excavator identified commercially as the model FIAT KOBELCO E215 and classified as a 20 tonne machine. The machine 1 comprises a base 2, movable on the ground, a turret 3 hinged to the base 2 around a vertical axis 4 and an operative arm 5, which is rotatable with respect to the turret 3 around a horizontal axis 6 under the action of a pair of preferably hydraulic linear actuators 7 (of which only one is visible in FIG. 1) positioned at opposite lateral parts of the arm 5. The arm 5 is constituted by two elongated elements 9,10, mutually arranged in series, hinged to each other around an axis 11 parallel to the axis 6, and comprises a terminal or distal portion 13 which bears a work accessory, in particular a bucket 14, hinged around an axis 15 parallel to the axis 6.

The arm 5 further bears two actuating devices 16,17 comprising respective linear actuators 18,19, which are operated by a hydraulic system 21 of the machine 1 (schematically and partially shown in FIG. 5), to rotate the element 10 around the axis 11 and, respectively, the bucket 14 around the axis 15. The device 17 further comprises a lever assembly 22 defining an articulated quadrilateral together with the terminal portion 13. The lever assembly 22 comprises two levers 23,24, which, at one end, are hinged to each other and to the stem or rod 25 of the actuator 19 around a same axis and, at the opposite end, are hinged to the terminal portion 13 and, respectively, to the bucket 14.

Figures 2, 2A:
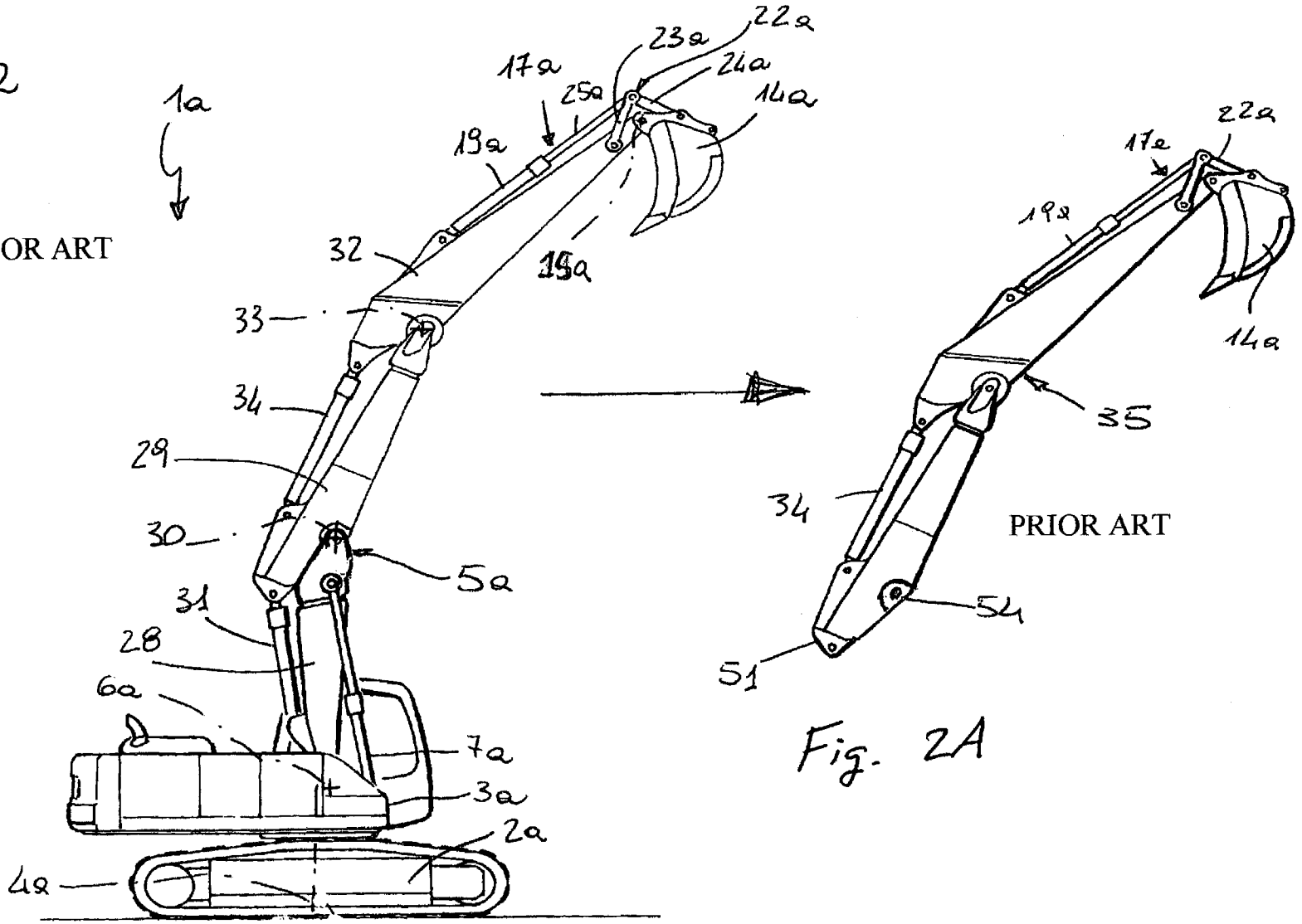
FIG. 2A shows a partial, lateral elevation view of an operating arm of the excavator shown in FIGS. 1 and 2.

FIGS. 2 and 2A show a further excavator, such as an excavator identified commercially as the model FIAT KOBELCO B135 and classified as a 13 tonne machine. The components of the machine 1*a* are indicated, when possible, by the same reference numbers as the machine 1, followed by the reference letter "a". The machine 1*a* differs from the machine 1 in that it is of a lower loading class, as indicated above, and in that the operative arm 5*a* is constituted by three elongated elements, instead of two, arranged in series and mutually hinged around axes parallel to the axis 6*a*. In particular, the arm 5*a* comprises an element 28 that is rotatable with respect to the turret 3*a* around the axis 6*a* under the action of the actuators 7*a*, an element 29 that is rotatable relative to the element 28 around an axis 30 under the action of a linear actuator 31, and an element 32, which is rotatable relative to the element 29 around an axis 33 under the action of a linear actuator 34 and bears hinged, at its own end, a work accessory, in particular a bucket 14*a*, and an actuating device 17*a* similar to the device 17 and able to be operated to rotate the bucket 14*a* around the axis 15*a*.

Figure 3:
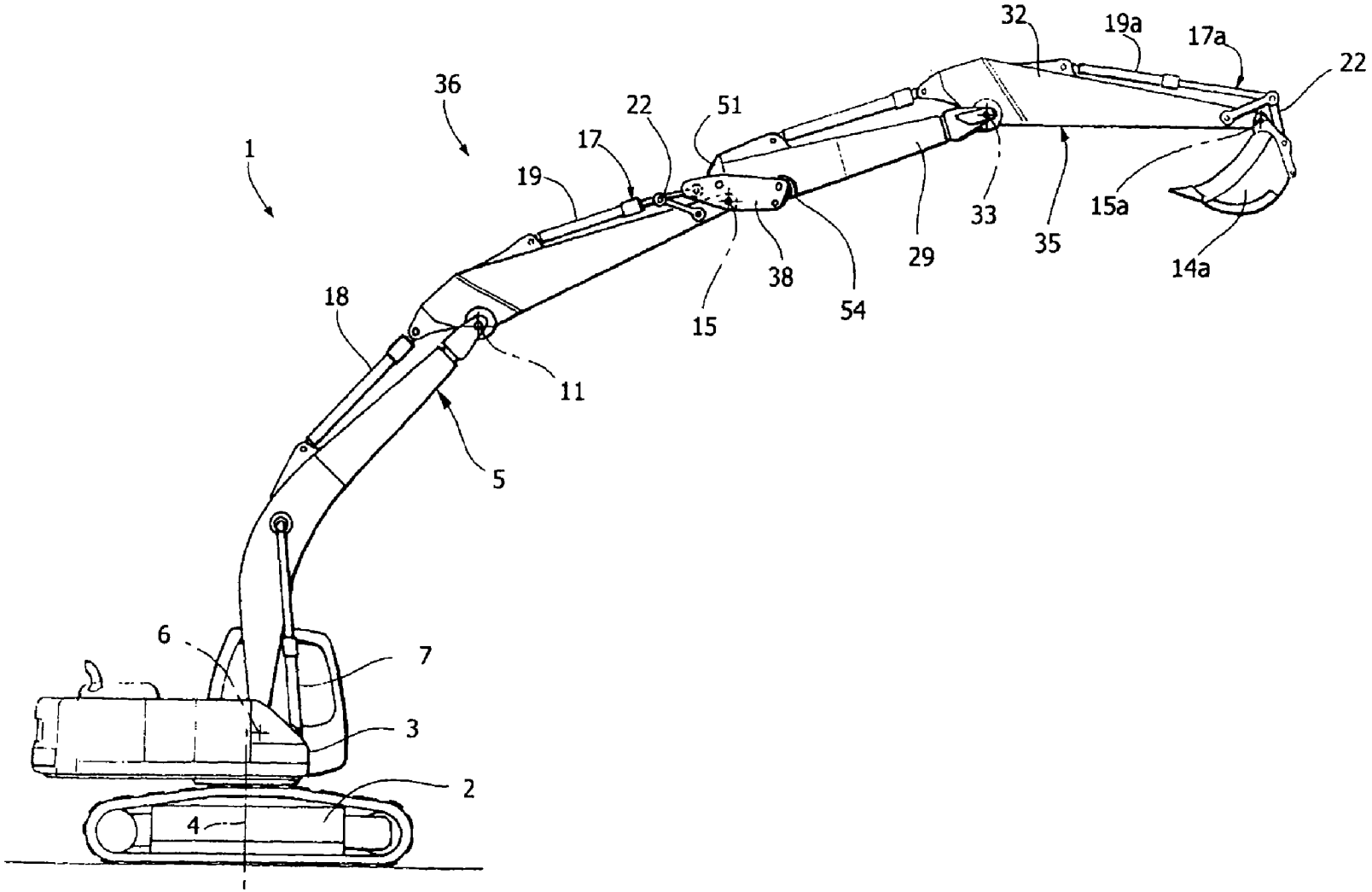
FIG. 3 is similar to FIGS. 1 and 2 and shows the machine of FIG. 1 with the operative arm configured according to the method of the preferred embodiment.

According to the preferred embodiment, the components designated as 29, 32, 34, 14*a*, 17*a* are used to convert the machine 1 and obtain an arm 36 with a wide range of action (as shown in FIG. 3). In particular, the bucket 14 of the machine 1 is an interchangeable member and it is uncoupled and replaced by an extension 35 which is coupled to the portion 13 and to the lever 24 by means of the interposition of an adapter body 38 and, according to the particular example described, it is constituted by the elements 29 and 32 and it bears the actuator 34, the device 17*a* and the bucket 14*a*.

Figure 4:
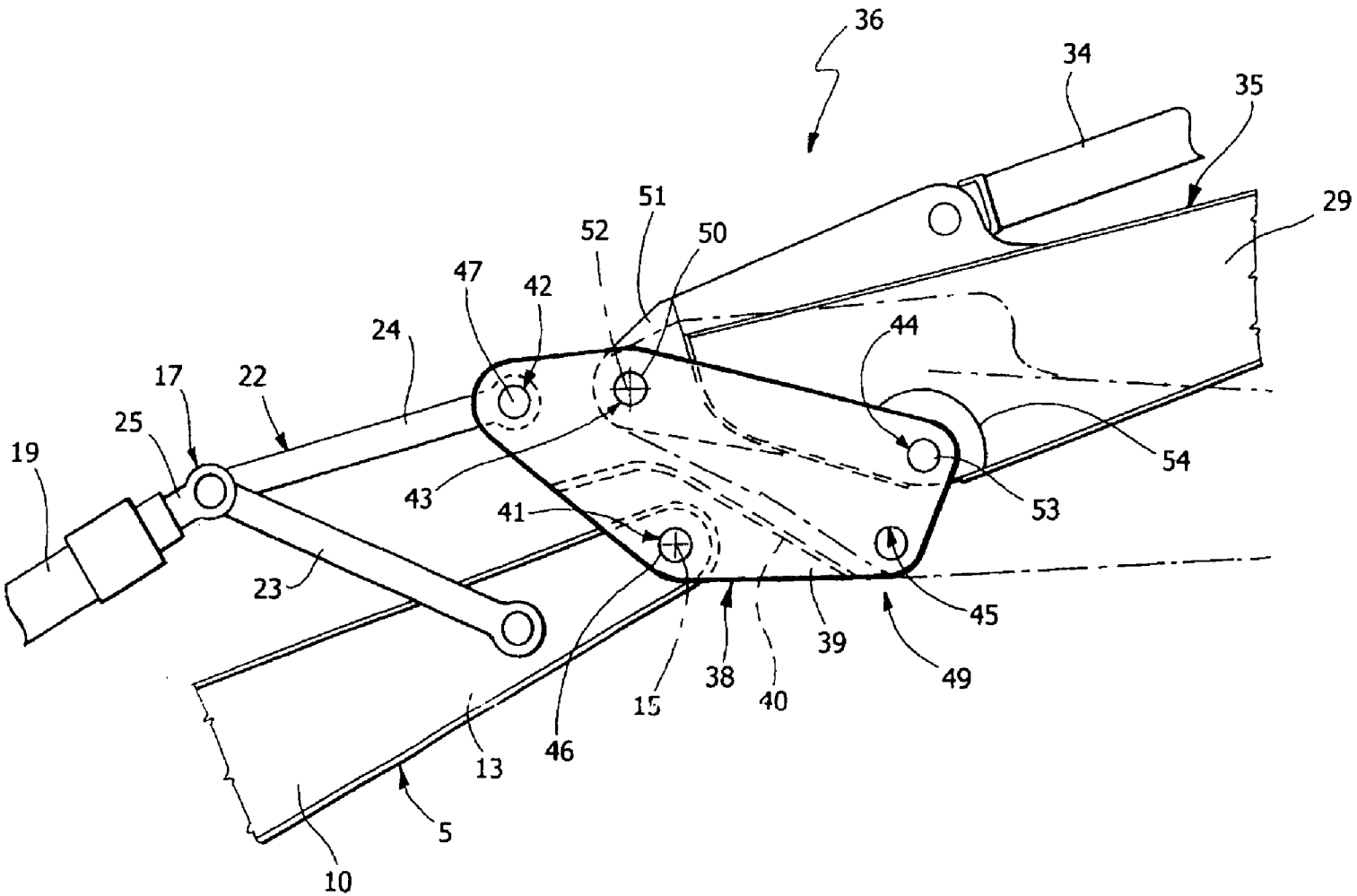
FIG. 4 shows in enlarged scale a detail of FIG. 3.

With reference to FIG. 4, the adapter body 38 comprises two lateral walls 39, parallel to and facing each other (of which only one is visible) and an intermediate transverse wall 40 connected, preferably by welding, to the walls 39. The walls 39 are positioned, in use, at opposite sides of the element 29 and of the terminal portion 13 and comprise five attachment points defined by respective pin seats 41, 42, 43, 44 and 45, each of which is formed as a through-hole through the walls 39 of the adapter body 38.

The seats 41 and 42 can be engaged by respective hinge pivot pins 46,47 and define respective hinges for coupling the body 38 to the portion 13 and, respectively, to the lever 24, similar to those of the bucket 14. The seats 43, 44 and 45, instead, are a part of a fastening and regulating device 49 for locking the extension 35 to the body 38 in a first angular position (shown in continuous line) which allows the maximum extension of the arm 36, or in a second angular position (shown in dashed and dotted line) which allows to close the arm 36 back within a minimum size profile for road circulation. The device 49 comprises a cylindrical pivot pin 50 able to engage the seat 43 to hinge the body 38 to a portion 51 of the element 29 around a fixed axis 52, and a pivot pin 53 able selectively to engage one of the seats 44, 45 and lock the body 38 to a portion 54 of the element 29 and obtain, respectively, the two angular positions described above. In particular, the portions 51 and 54 respectively delimit cylindrical seats able to be engaged by the pivot pins 50, 53 substantially without play and hinged, in the machine l*a* (FIG. 2), to the actuator 31 and, respectively, to the element 28.

The extension 35 is fastened to the body 38 by hinging first the portion 51 to the seat 43 around the axis 52, then rotating the extension 35 in the desired position, and lastly coupling the pivot 53 to lock the extension 35 and the body 38 to each other.

Figure 7:
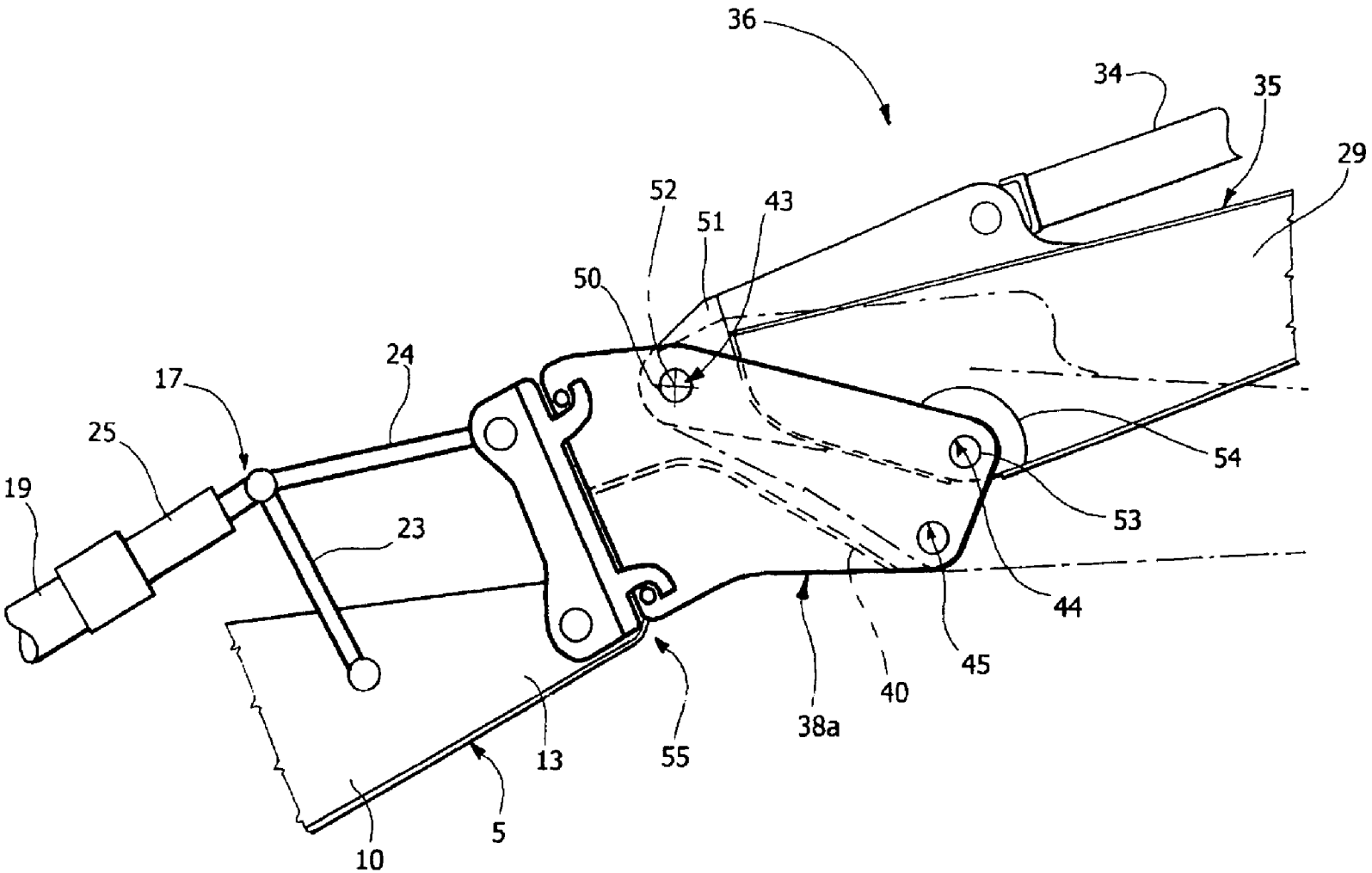
FIG. 7 is similar to FIG. 4 and shows a variation of the machine of FIG. 3.

FIG. 7 shows a variation of the arm 36, where an adapter body 38*a* is used, which differs from the body 38 in that it is coupled to the portion 13 and to the lever 24 by means of a quick coupling device 55 (schematically illustrated), known in itself and not described in detail, instead of directly by the hinge pivot pins 46, 47.

Figure 5:
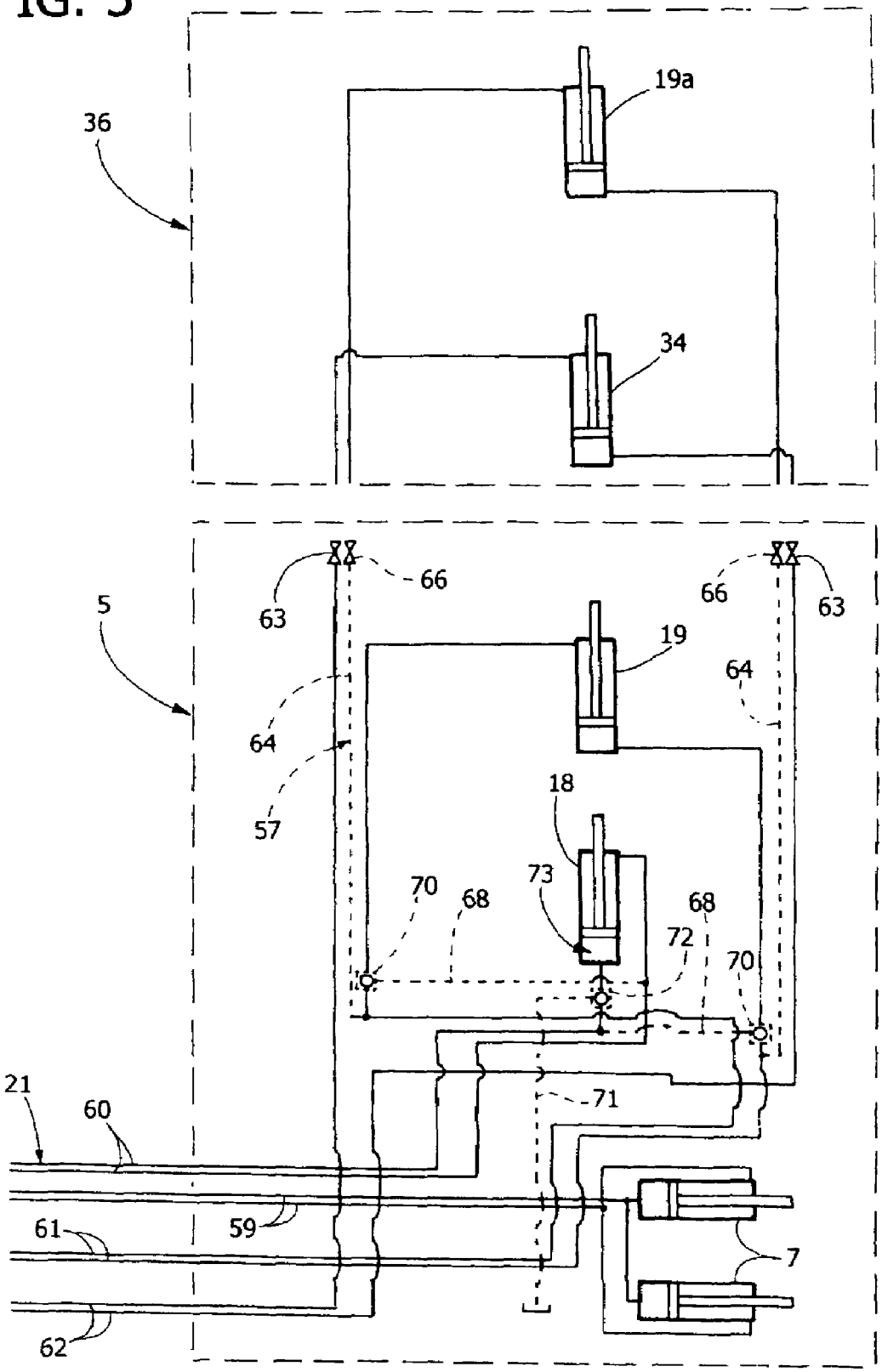
FIGS. 5 and 6 are partial schematic diagrams of the hydraulic system of the machine of FIGS. 1 and 3.
Figure 6:
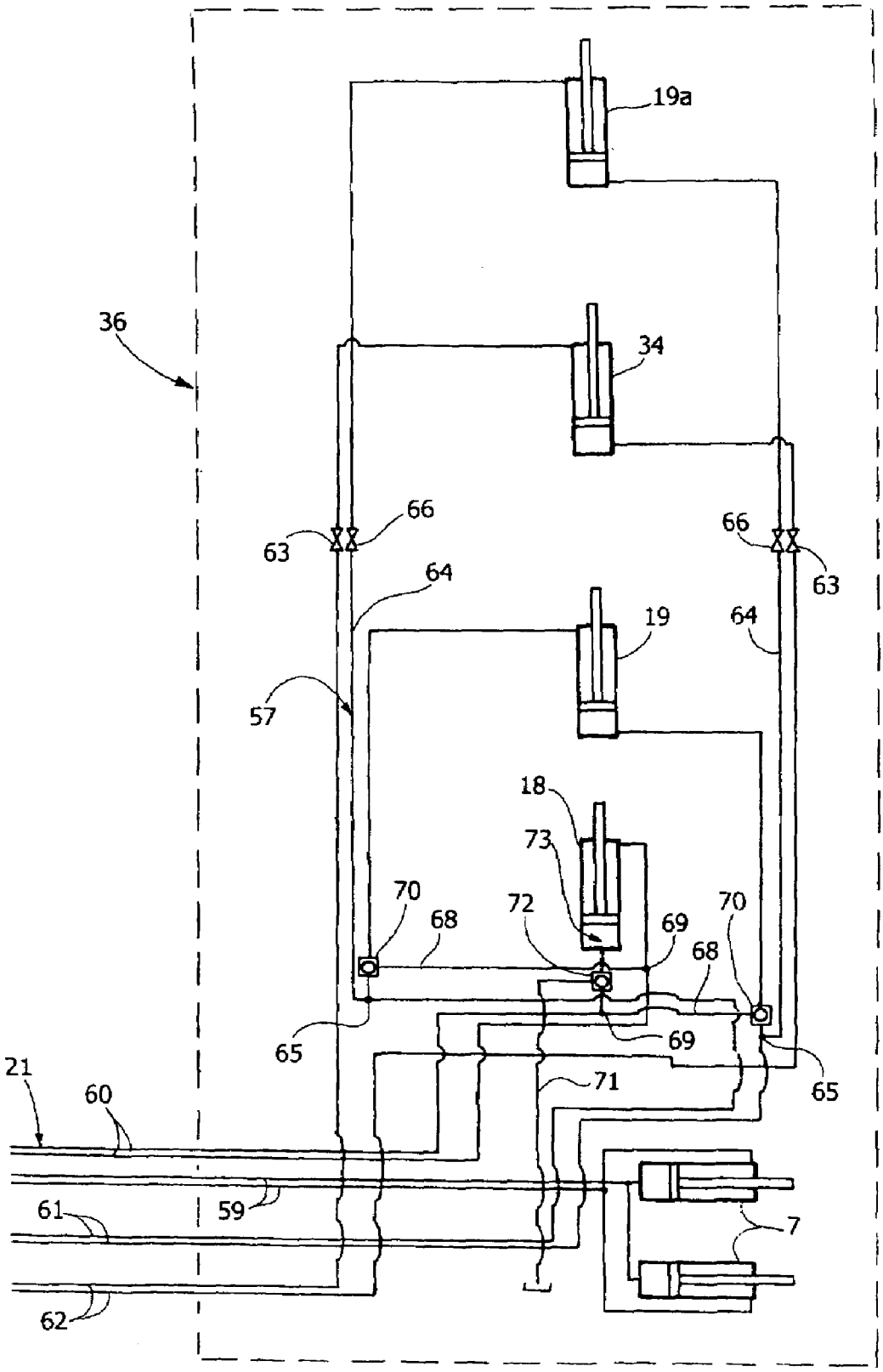

With reference to FIGS. 5 and 6, the hydraulic system 21 according to the preferred embodiment includes a set 57 of hydraulic lines and of valves (schematically shown in dashed line in FIG. 5 and in continuous line in FIG. 6) to operate the actuators 34, 19*a* borne by the extension 35 by means of the control instruments (not shown) available aboard the turret 3.

The hydraulic system 21, on a currently produced machine 1, comprises two lines 59, two lines 60, two lines 61 and two lines 62, which are controlled in a known manner, for the operation, respectively, of the actuators 7, of the actuator 18, of the actuator 19 and of an optional actuator (not shown), which is borne by an accessory 14 such as a hammer or by a gripping claw. The lines 62 include respective cocks 63 for connection to the optional actuator.

With reference to FIG. 6, the set of lines 57 comprises two lines 64 mounted on the arm 5, connected, at one side, to the lines 61 by means of respective pipe fittings 65 and provided, at the other side, with respective outlet cocks 66. The set 57 further comprises two lines 68, mounted on the arm 5 and connected, at one side, to the lines 60 by means of respective pipe fittings 69 and, at the other side, to the lines 61 by means of respective three-way valve 70 in intermediate position between the actuator 19 and the pipe fittings 65. Lastly, the set of lines 57 comprises a line 71 connected, at one side, to an exhaust and, at the other, to one of the lines 60 by means of a three-way valve 72 in intermediate position between a chamber 73 of the actuator 18 and the related pipe fitting 69.

The valves 70 and 72 can be switched between a first and a second operative position. In the first operative position (FIG. 5), the valves 70 transmit the pressure signals of the lines 61 towards the actuator 19 and maintain closed the connection between the lines 68 and the lines 61, while the valve 72 maintains closed the connection of the chamber 73 with the line 71 and open the one with the respective pipe fitting 69, in such a way as to rotate the element 10 and the bucket 14 by means of the control signals of the line 60 and, respectively, 61. In the second operative condition (FIG. 6), instead, the valves 70 interrupt the connection of the actuator 19 with the lines 61 and open, at the same time, the connection with the lines 68, while the valve 72 opens the connection of the chamber 73 with the line 71 and with the exhaust, and closes the connection with the respective pipe fitting 69, in such a way as to operate the actuators 34, 19*a*.

In particular, once the set 57 is connected to the original system 21 and the extension 35 is connected to the arm 5, the actuators 34, 19*a* are connected to the cocks 63 and, respectively, 66, said cocks 63, 66 are opened, and, starting from the first operative position, the valves 70 are switched to transmit the control of the lines 61 to the actuator 19*a* and, at the same time, the control of the lines 60 to the actuator 19. The valve 72 is then also switched to discharge the chamber 73, leaving under pressure the other chamber of the actuator 18 under the control of the line 60, in such a way as to maintain the stem or rod of the actuator 18 completely retracted or extended and, hence, the element 10 in fixed position. Obviously, use of the accessory 14 can be restored, closing the cocks 63 and 66, replacing the extension 35 and switching the valves 70, 72 back to the first operative position.

From the above, it is readily apparent that the configuration of the arm 5, thanks to the body 38, can use an extension 35 that is not of a dedicated type, but is available directly from a machine that is already in production, and that the set 57 used to complement the system 21 is constituted by components that are easily available on the market and are easily mounted on the machine 1, with no need to modify the control instruments on the turret 3 and/or the control valves of the system 21.

The sole dedicated element is the adapter body 38 which, however, has is simple structure to design and construct, and can be connected to the arm 5 and to the extension 35 in extremely simple manner, using attachment points already located on the elements 10, 29 and on the lever 24. Moreover, the machine 1 can continue to be used as a standard excavator, replacing the extension 35 with the accessory 14 again.

The described method requires no changes to the lever assembly 22 or to the structure of the arm 5 and/or to the actuators 7, in particular when the extension used for the configuration constitutes part of a machine of lower loading class, like the machine 1*a* indicated by way of example, in that a relatively small weight is added which does not overload the hinging structures between the arm 5 and the turret 3. Moreover, the seats 44, 45 allow one to change the angular position of the extension 35 relative to the arm 5 as needed to obtain the maximum extension of the arm 36 or a minimum sized profile for road circulation.

The lines 64 and the switching of the valves 70 allow one to control the accessory 14*a* aboard the turret 3 by means of the same control instruments which are used to operate the accessory 14, without requiring the operator to learn to use new controls. At the same time, the switching of the same valves 70 causes control to pass from the actuator 18 to the actuator 19 to enable to rotate the extension 35 around the axis 15, while the actuator 18 is deactivated by discharging the chamber 73.

From the above, lastly, it is readily apparent that the method described with reference to the accompanying figures can be subject to modifications and variations, without thereby departing from the scope of protection of the present invention.

In particular, the invention can be applied to accessories other than buckets and to arms and/or extensions constituted by elements in different numbers and with different shapes relative to what is indicated purely by way of example herein. The actuator 19*a* could be connected to the lines 62, with no need to add the set 57, or a dedicated system could be provided for controlling all the actuators 18, 19, 34, 19*a*, or the set 57 could comprise different switching valves from the valves 70, and/or lack the lines 68 and 71, to control the actuator 18 through the lines 60 in any configuration of the operative arm.

Moreover, after switching control of the actuator 18 to another actuator, the element 10 could be maintained in fixed position relative to the element 9 in a different manner from the one described, e.g. by means of mechanical retention systems.

Moreover, the body 38 could be coupled to the extension 35 in different manners and/or points from those described by way of example herein, and/or could have different shape and/or have attachment points in different positions, to be coupled to normally produced arms other than those illustrated herein.

Additionally, on the body 38 could be provided a higher number of reference seats to regulate the angular position of the extension 35.

We claim:

1. A method of configuring an operative arm of a normally produced earth moving machine, the operative arm including a main arm connected to a chassis of the earth moving machine and a distal arm connected to the main arm, the method comprising the steps of:

providing a single adaptor body having a first and a second plurality of pin seats;

coupling the adapter body to an end of the distal arm using the first plurality of pin seats;

coupling an extending arm to the distal arm via the second plurality of pin seats in the adapter body; and adjusting the angular position of the extending arm relative to the adapter body, wherein one of two angular positions is possible.

2. The method of claim 1, wherein the step of coupling the adapter body includes coupling the adapter body to two pin seats of the extending arm.

3. The method of claim 1, wherein the operative arm bears a first actuator operated by first control lines to rotate the adapter body and the extending arm bears a second actuator to rotate a work accessory, the method further comprising the steps of connecting the first control lines to the second actuator, and switching a control of the first control lines between the first and second actuators.

4. An excavator comprising:

an undercarriage including a track;

a turret rotatable on the undercarriage, the turret including a chassis;

a first operative arm set comprising (i) a main arm rotatably mounted on the chassis, (ii) a first distal arm rotatably mounted on the main arm, (iii) a main hydraulic actuator coupled to the main arm and the chassis and (iv) a first distal hydraulic actuator, the main hydraulic actuator being operable to rotate the main arm relative to the chassis and the first distal hydraulic actuator being coupled at a proximal end to the first distal arm;

a second operative arm set comprising (i) an intermediate arm, (ii) a second distal arm rotatably coupled to the intermediate arm, (iii) an intermediate actuator coupled to the intermediate arm and the second distal arm and (iv) a second distal hydraulic actuator coupled to the second distal arm;

a single adapter body coupling the first operative arm set to the second operative arm set, the adaptor body having a first plurality of pin seats and a second plurality of pin seats; and a work tool coupled to a distal end of the second distal arm, wherein the first distal arm includes a distal end coupled to a first pair of the first plurality of pin seats on the adapter body, the intermediate arm includes a proximal end coupled to the second plurality of pin seats on the adapter body and a distal end coupled to the second distal arm, and the second distal arm includes a proximal end coupled to the intermediate arm and a distal end coupled to the work tool, and wherein the distal end of the first distal arm is adapted to be coupled to the work tool whereby the work tool and adapter body are interchangeable.

5. The excavator of claim 4, wherein the first distal arm comprises a lever assembly, a distal end of the first distal hydraulic actuator is coupled to the lever assembly to rotate the lever assembly relative to the first distal hydraulic actuator, and the lever assembly is coupled to a second pair of the first plurality of pin seats on the adapter body whereby the first distal hydraulic actuator may rotate the adapter body about an axis through the first pair of pin seats of the first plurality.

6. The excavator of claim 5, wherein the second distal arm comprises another lever assembly, the second distal hydraulic actuator is coupled to the other lever assembly to rotate the other lever assembly relative to the second distal hydraulic actuator, and the work tool is coupled to the other lever assembly.

7. The excavator of claim 6, wherein the lever assembly and the other lever assembly are interchangeable.

8. The excavator of claim 4, further comprising a plurality of hydraulic valves and means for switching the hydraulic valves to control at least one of the main hydraulic actuator, the first distal hydraulic actuator, the intermediate hydraulic actuator and the second distal hydraulic actuator.

9. The method of claim 1, wherein the first plurality of pin seats are fixed on the adapter body in relation to the second plurality of pin seats.

* * * * *